US006787996B1

(12) United States Patent
Saito et al.

(10) Patent No.: US 6,787,996 B1
(45) Date of Patent: Sep. 7, 2004

(54) LAMP SEAL USING FUNCTIONALLY GRADIENT MATERIAL

(75) Inventors: Katsuya Saito, Takasago (JP); Toyohiko Kumada, Himeji (JP); Yukiharu Tagawa, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/544,615

(22) Filed: Apr. 6, 2000

(30) Foreign Application Priority Data

Apr. 6, 1999 (JP) ..... 11-099427
Apr. 19, 1999 (JP) ..... 11-111510

(51) Int. Cl.[7] ..... H01J 61/36; H01J 17/18

(52) U.S. Cl. ..... 313/625; 313/623; 313/624; 313/626; 313/631; 313/634

(58) Field of Search ..... 313/623–626, 313/631, 634

(56) References Cited

U.S. PATENT DOCUMENTS

| | | | | |
|---|---|---|---|---|
| 5,742,123 A | | 4/1998 | Nagayama | |
| 5,861,714 A | * | 1/1999 | Wei et al. | 220/2.1 R |
| 5,932,969 A | * | 8/1999 | Ikeuchi et al. | 313/623 |
| 6,194,832 B1 | * | 2/2001 | Juengst | 313/623 |
| 6,271,627 B1 | * | 8/2001 | Morimoto et al. | 313/623 |
| 6,375,533 B1 | * | 4/2002 | Torikai et al. | 445/26 |

FOREIGN PATENT DOCUMENTS

| | | | | |
|---|---|---|---|---|
| DE | 197 30 137 | | 1/1998 | |
| EP | 0 887 838 | | 12/1998 | |
| EP | 0 987 736 | | 3/2000 | |
| EP | 1049134 A1 | * | 11/2000 | H01J/61/36 |
| JP | 9-115484 | | 5/1997 | H01J/61/36 |
| JP | 10172514 A | * | 6/1998 | H01J/61/36 |
| JP | 11297273 A | * | 10/1999 | H01J/61/36 |
| WO | WO99/13493 | | 3/1999 | |

* cited by examiner

*Primary Examiner*—Nimeshkumar D. Patel
*Assistant Examiner*—Sikha Roy
(74) *Attorney, Agent, or Firm*—Nixon Peabody LLP; David S. Safran

(57) ABSTRACT

To provide a lamp seal that avoids cracking of the functionally gradient material in the manufacturing process, that assures adequate mechanical strength of the finished product, and that has improved productivity because of the ease of welding when the light-emitting tube of the lamp is sealed, the lamp seal (20) comprising a functionally gradient material (21) and a lead bar (11), in which the functionally gradient material (21) has layers of mixtures of electrically non-conductive material and conductive material such that one end is non-conductive and the other end is conductive, with layers such that the proportion of conductive material increases in stages or continually moving from one end to the other, in which the lead bar (11) passes through a hole formed in the direction of layering of the functionally gradient material and is attached in the conductive region of the functionally gradient material (21), has the proportion of conductive material at the point of attachment (26) of the lead bar (11) to the functionally gradient material set at no less than 0.6 Vol % and no more than 39 Vol %. Furthermore, a gap (24) is created between the lead bar (11) and the functionally gradient material (21) in the region from the point of attachment (26) to the non-conductive end of the functionally gradient material (21).

3 Claims, 7 Drawing Sheets

FIG. 4

| $SiO_2$ - Mo Mixture | Mo content (Vol%) | Thickness of layer (mm) |
|---|---|---|
| 1st layer | 0 | 11.5 |
| 2nd layer | 0.6 | 2.5 |
| 3rd layer | 1.1 | 2.5 |
| 4th layer | 2.3 | 2.5 |
| 5th layer | 3.7 | 2 |
| 6th layer | 5.1 | 2 |
| 7th layer | 8.5 | 2 |
| 8th layer | 13 | 2 |
| 9th layer | 21 | 3.5 |
| 10th layer | 29 | 3.5 |
| 11th layer | 39 | 5.5 |
| 12th layer | 55 | 10.5 |

FIG. 7

| | Diameter D (mm) of functionally gradient material | Diameter d (mm) of lead bar | Proportion (Vol%) of conductive component at point of attachment | Hole diameter C (mm) | Evaluation |
|---|---|---|---|---|---|
| Implementation 2 | 7 | 2 | 39 | 2.7 | ○ |
| Implementation 3 | 7 | 3 | 39 | 3.8 | ○ |
| Implementation 4 | 11 | 3 | 13 | 6.5 | ○ |
| Implementation 5 | 11 | 3 | 39 | 6.5 | ○ |

LAMP SEAL USING FUNCTIONALLY GRADIENT MATERIAL

BACKGROUND OF THE INVENTION

1. Field of the Invention

This invention concerns the seal material for lamps, such as xenon lamps and halogen lamps.

2. Description of Related Art

Functionally gradient materials are composed of mixed sinters of, for example, an electrically conductive material, such as a metal, and a non-conductive material, such as an oxidation product of a metal. By varying the proportion of the conductive material in stages in a specified direction, it is possible to form a material that has a conductive portion where there is a high proportion of the conductive material as well as a non-conductive portion where there is a low proportion of the conductive material. The conductive and non-conductive portions make up a solid whole that is well-suited as a seal material that forms a current feed in lamp seals.

When this sort of functionally gradient material is used as a lamp seal, it is necessary for the electrical feed lead bar to pass through the functionally gradient material in order to provide electrical contact between the inside and outside of the lamp. For example, it is possible to make a through-hole for the lead bar from the end of the functionally gradient material in the direction of the build-up, or to make non-through lead bar holes in each end of the functionally gradient material and insert the lead bar into one of the holes.

With such functionally gradient materials, if a tungsten lead bar is attached as within the functionally gradient material, the lead bar and the functionally gradient material will be attached even in the region of the functionally gradient material where there is a high proportion of non-conductive material. Thus, cracking sometimes occurs in the post-sintering cooling stage of the process of manufacturing the functionally gradient material, due to the different indices of thermal expansion of the tungsten and the non-conductive material.

Methods to solve the problem described above have been proposed, including the method of leaving a gap between the lead bar and the functionally gradient material so that there is no contact between the two in the region where there is a large difference between their indices of thermal expansion. For example, this sort of seal using functionally gradient materials is described in Japanese Kokai Patent Publication HE1-115484 (1997).

The technology is to prevent cracking of the functionally gradient material due to a difference in indices of thermal expansion during operation of a lamp using a seal made of a functionally gradient material, by having no contact between the outer surface of the lead bar and the inner surface of the lead bar hole through the functionally gradient material. The structure described has a gap between the lead bar hole in the functionally gradient material and the lead bar itself.

Nevertheless, this technology is technology to prevent the occurrence of cracking during operation of the lamp; there is no consideration at all given to preventing the cracking that occurs during the post-sintering cooling stage of the process of manufacturing the functionally gradient material. Therefore there is no mention of the region of the functionally gradient material to which the lead bar is best attached, and that method cannot prevent the cracking which occurs during the process of manufacturing the functionally gradient material, which is the task of the invention of this application.

Other disclosures of the use of functionally gradient materials in lamp seals can be found in commonly owned, co-pending U.S. Pat. Nos. 6,107,740; 6,271,627 and 6,175,188.

SUMMARY OF THE INVENTION

It is an object of this invention to provide a lamp seal that avoids cracking of the functionally gradient material in the manufacturing process, and thus, assures that the finished product has adequate mechanical strength. Moreover, it is desired to provide a lamp seal with improved productivity when the light-emitting tube of the lamp is sealed by improving the case with which welding can be performed.

In order to achieve this object invention provides a lamp seal comprising a functionally gradient material and a lead bar, in which the functionally gradient material has layers of mixtures of electrically non-conductive material and conductive material such that one end is non-conductive and the other end is conductive, the proportion of conductive material in the layers increasing in stages or continually moving from one end to the other, in which the lead bar passes through a hole formed in the direction of layering of the functionally gradient material and is attached in the conductive region of the functionally gradient material, and in which the proportion of conductive material at the point of attachment of the lead bar to the non-conductive end of the functionally gradient material is no less than 0.6 Vol % and no more than 39 Vol %.

In accordance with the invention, the hole is cylindrical but has a larger diameter at the non-conductive end, such that, when C is the inside diameter of the cylindrical hole, d is the outside diameter of the hole and D is the outside diameter of the functionally gradient material, in the region from the non-conductive end of the functionally gradient material to the point of attachment of the lead rod, the inside diameter C satisfies the condition $1.2\ d \leqq C \leqq 0.6D$.

Alternatively, the hole can expand in tapered form from the point of attachment toward the non-conductive end, with the thickness of the functionally gradient material from the point of attachment to the non-conductive end being less than its thickness at the point of attachment.

Moreover, in some embodiment, the outside diameter of the functionally gradient material at and near the non-conductive end is smaller than the outside diameter at the point of attachment.

The invention of this application is one which prescribes the region where the lead bar should be attached to functionally gradient material that has a layered structure with variation in the proportion of the conductive component. Specifically, the hole which allows the lead bar to pass through the functionally gradient material is divided into two regions; in one region the lead bar is attached to the functionally gradient material where the proportion of the conductive material is at a specified level, and in the other region there is a gap between the lead rod and the functionally gradient material so that the two are not in contact.

If the gap between the lead bar insertion hole and the lead bar is too short along the length of the lead bar, or in other words, if the non-contact region is the smaller of the two, then the point of attachment of the lead bar and the functionally gradient material is in the region of a higher proportion of the non-conductive component. In the process of manufacturing, the functionally gradient material, therefore, cracking is liable to occur in the cooling stage following sintering. On the other hand, if the gap is too long along the length of the lead bar, or in other words, if the non-contact region is too much longer, there will be little mechanical strength at the point of attachment of the lead bar and the functionally gradient material. For that reason, the seal material may break under pressure when it is fixed in place, or if the operator mistakenly touches the functionally gradient material.

The relationship between the inner diameter of the lead bar insertion hole and the outer diameter of the lead bar is explained next.

First, if the inner diameter of the lead bar insertion hole is too small, and the gap between the lead bar and the functionally gradient material is too narrow, during sintering in the process of manufacturing the functionally gradient material, the functionally gradient material will contract greatly, and at the same time, the lead bar inserted in the hole will undergo thermal expansion, so that the functionally gradient material will contact the lead bar in the region of a high proportion of the non-conductive material, and cracking will occur. And if the inner diameter of the lead bar insertion hole is too large, the wall of functionally gradient material will be too thin and handling during the production process prior to sintering will be difficult, resulting in breakage of the functionally gradient material. Moreover, even after the seal piece is created, deformation of a seal that is too thin during the subsequent process of manufacturing, such as when the silica light-emitting tube of the lamp is sealed by welding, would lead to problems in the manufacturing process.

If the diameter of the lead insertion hole is too large, on the other hand, and the wall of the seal is too thin, the thermal capacity of the seal will be reduced, and there will be problems in that the seal of the light-emitting tube will not be completely sealed.

The invention of this application provides a highly reliable lamp seal in which the proportion of conductive material at the point of attachment of the lead bar to the non-conductive end of the functionally gradient material is no less than 0.6 Vol %, which will prevent cracking of the functionally gradient material even during cooling after sintering, and is no more than 39 Vol %, which will facilitate handling of the functionally gradient material during the manufacturing process and will provide adequate mechanical strength in the finished product.

The use, according to the invention, of a hole formed in the direction of layering of the functionally gradient material which is a cylindrical hole with an expanded section will prevent contact with the internal surface of the functionally gradient material even during thermal expansion of the lead bar, if the hole's inside diameter C is greater than 1.2 d, where d is the outside diameter of the hole. Furthermore, if the hole's inside diameter C is less than 0.6D, where D is the outside diameter of the functionally gradient material, that will prevent breakage during manufacturing and also deformation of the seal piece when the light-emitting tube is sealed.

The third and fourth embodiments of this application facilitate seal processing and give final form to the sealing operation.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 4 is a table showing silica glass-molybdenum densities and the thickness of various layers of a functionally gradient material;

FIG. 7 is table showing the results of test cases 2 through 5.

DETAILED DESCRIPTION OF THE INVENTION

Figure 1:
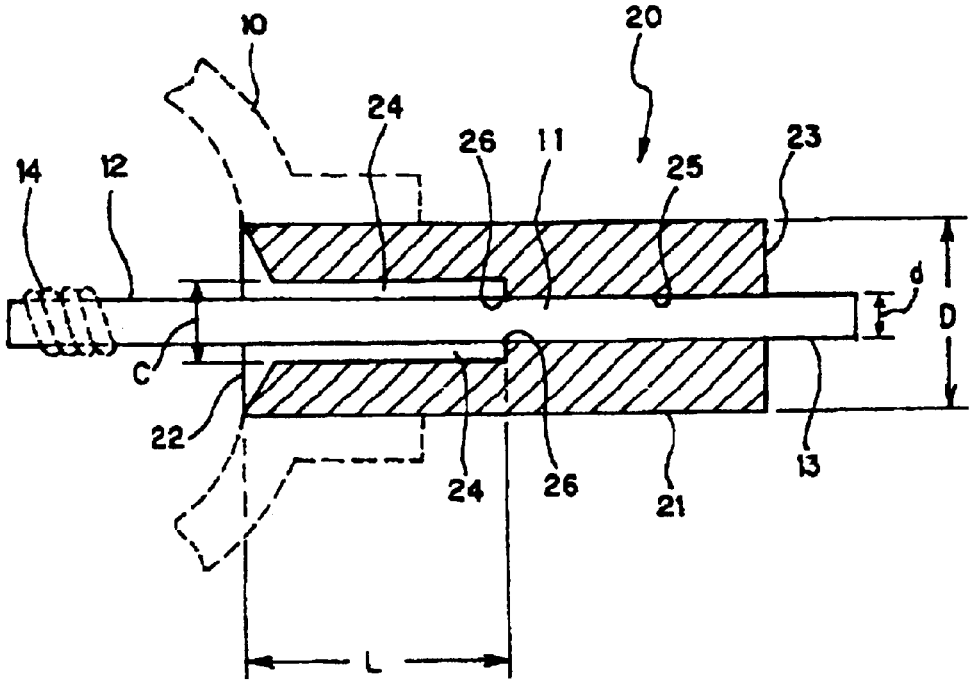
FIG. 1 is partial cross-sectional view showing an embodiment of the lamp seal using functionally gradient material of this invention.
Figure 2A:
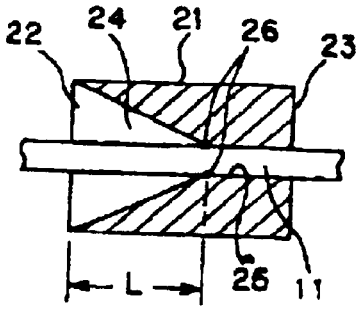
FIGS. 2(*a*) through 2(*d*) are cross-sectional views modified forms for the expanded hole of the lamp seal of the first embodiment of this application.
Figure 2B:
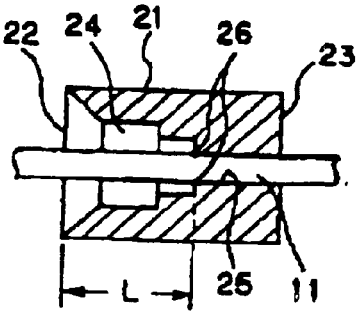
Figure 2C:
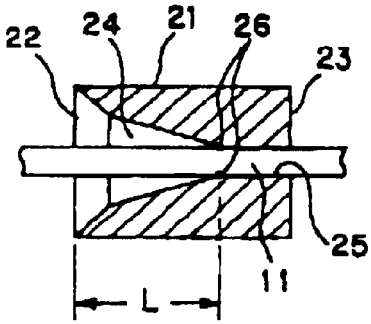
Figure 2D:
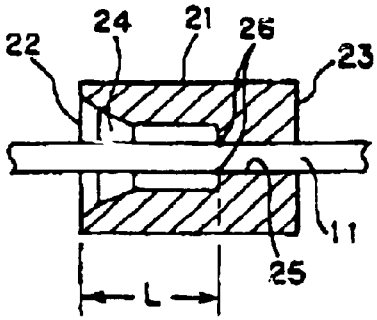
Figure 3A:
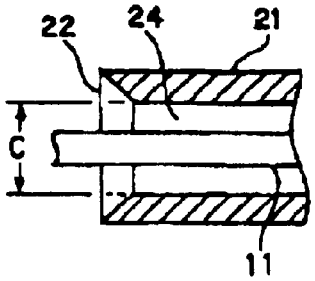
FIGS. 3(*a*) through 3(*e*) are cross-sectional views of a second embodiment of the lamp seal of the invention.
Figure 3B:
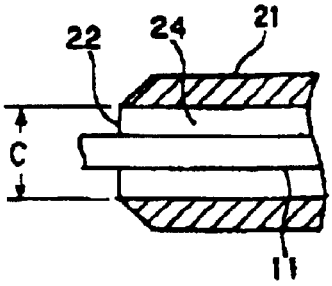
Figure 3C:
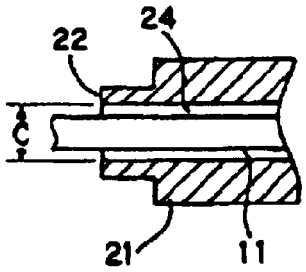
Figure 3D:
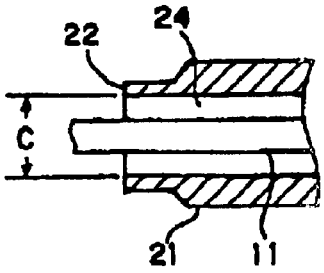
Figure 3E:
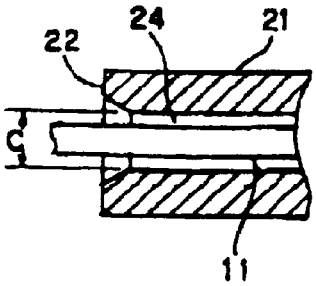

In FIG. 1, an example of the lamp seal 20 using the functionally gradient material of this invention is shown which comprises functionally gradient material 21 and a lead bar (electrode bar) 11. The functionally gradient material 21 has an insertion hole 25 for the lead bar 11, and the lead bar 11 passes through the insertion hole 25 and is attached therein at a point of attachment 26, to be described hereafter, between the lead bar 11 and the functionally gradient material 21. The functionally gradient material has a non-conductive end 22 and a conductive end 23. Within the functionally gradient material 21, the inside diameter of the insertion hole 25 is enlarged from the point of attachment 26 to the non-conductive end 22, forming a cylindrical gap 24 between the lead bar 11 and the functionally gradient material 21.

The functionally gradient material 21 is composed of, for example, a layer of non-conductive material and layers of mixed non-conductive and conductive components, with each of the mixed layers having different proportions of the components. Thus, the functionally gradient material 21 is layered such that the light-emitting tube 10 end (the non-conductive end 22) is a region rich in the non-conductive component, and the layers have an increasingly high proportion of the conductive component towards the opposite end (the conductive end 23). This seal 20, which comprises the functionally gradient material 21 and a lead bar 11, forms a seal structure when the light-emitting tube (bulb) 10, shown by broken lines in the figure, is welded to the region that is rich in the non-conductive component, on the left side in FIG. 1.

Possibilities for the non-conductive component include silica glass, quartz, alumina, zirconia, magnesia, silicon carbide, titanium carbide, silicon nitride, aluminum nitrate and so on, but of these, silica glass is best suited.

Possibilities for the conductive component include molybdenum, nickel, tungsten, tantalum, chrome, platinum, zirconiom and so on, but of these, molybdemun is best suited.

The lead bar is made of a tungsten wire with a diameter of 1 to 8 mm, and is a single piece comprising an inner lead 12 that extends beyond the non-conductive end 22 of the functionally gradient material 21 and an outer lead 13 that extends out from the other, conductive end. There is good conductivity when the inner lead 12 and the outer lead 13 make up a single lead bar 11 in this way, and it is possible to carry a large current. However, it is possible for the lead bar 11 to comprise a separate inner lead 12 and outer lead 13 inserted into opposite ends of the functionally gradient material 21, thus using the conductive component of the functionally gradient material 21 to provide the electrical path.

A coil 14 is wrapped around the tip of the inner lead 12, and functions when the lamp is turned on.

There are a number of methods for manufacturing functionally gradient materials, and the dry method, for example, can be adopted with good effect. More concretely, a powdered non-conductive material is packed into a mold that has a core piece to form the insertion hole 25, and a power layer of non-conductive material is formed; above that, mixtures with different proportions of conductive and non-conductive powders are packed into the mold in order from the mixture with the smallest proportion of conductive powder to that with the greatest proportion. Pressure is then applied to mold a layered cylindrical object.

The insertion hole 25 for the lead bar 11 is formed, in the pressure molding, with a larger inside diameter from the end with a high proportion of non-conductive powders up to the point of attachment 26. When this point of attachment 26 is in its final state, it will be a region in which the proportion of the conductive component is no less than 0.6 Vol % and no more than 39 Vol %. It is possible for example, to use a mold piece of a specified shape to enlarge the inner diameter of the hole 25 at the same time pressure is applied, or to cut out the lead bar insertion hole 25 after the pressure has been applied.

Next, the lead bar 11 is inserted in the hole 25 in the functionally gradient material 21 that had been pressure-molded as described above, and the molding is then partially sintered for 30 minutes at 1200° C. under an atmosphere of non-oxidizing gas. Then, the partially sintered functionally gradient material 21 is fully sintered by heating it to a temperature higher than was used for the partial sintering. For example, the full sintering can be performed by heating the partially sintered functionally gradient material to the temperature range of 1720 to 1750° C. for 10 to 15 minutes. As a result, at the same time that the functionally gradient material 21 becomes fully sintered, it contracts and the hole 25 is tightened, fixing the lead bar 11 firmly in place as a part of the functionally gradient material 21.

The proportion of the conductive component of the functionally gradient material 21 at the point of attachment 26 is no less than 0.6 Vol % and no more than 39 Vol %. Furthermore, there is, from the non-conductive end 22 of the functionally gradient material to the point of attachment 26, a cylindrical gap such that the lead bar 11 does not contact the inside surface of the hole 25.

In accordance with the first embodiment of this invention, it is possible to prevent cracking during the post-sinter cooling stage of the functionally gradient material 21 with the lead bar 11 inserted, despite the difference in the indices of thermal expansion of the two. And because the mechanical strength of the functionally gradient material 21 is maintained, it is safe from breakage even if a person touches the functionally gradient material 21 by mistake or if pressure is applied to it when the lamp base is fitted to it.

In accordance with this invention, the lead bar insertion hole 25 meets the condition $1.2 \leqq C \leqq 0.6D$ where C is the inside diameter of the hole 25, and D is the outside diameter of the functionally gradient material 2, in the region from the non-conductive end 22 to the point of attachment 26 of the lead bar 11 (the region marked L in the figure).

Produced in that way, when the functionally gradient material 21 contracts in the sintering process and the lead bar 11 undergoes thermal expansion, the gap 24 will be sufficient and there will be no contact between the two at high temperatures. Therefore, it is possible to prevent cracking during the full sintering.

Moreover, even if a larger inside diameter is desired for the hole 25, the hole forming stage of the manufacturing process of the seal 20 of this invention is simple and its productivity is good, and the mechanical strength of the finished product can be assured. In addition, when the seal 20 of the invention of this application is used to seal the light-emitting tube of the lamp, there is no danger that the seal wall of the functionally gradient material 21 will be too thin and deform, and no danger of cracking because of contact between the lead bar 25 and the part of the functionally gradient material 21 with a high proportion of the non-conductive component.

It is possible to implement this invention with different shapes for the insertion hole 25 in the functionally gradient material 21. For example, those shown in FIGS. 2(*a*) through 2(*d*) are usable. In FIGS. 2(*a*) and 2(*c*), except at the point of attachment of the non-conductive end of the functionally gradient material to the lead bar, the insertion hole tapers outward from the point of attachment to the non-conductive end, and the wall thickness of the non-conductive end is less than that at the point of attachment.

As in the drawings, the inner diameter of the opening of the hole 25 from the point of attachment 26 to the non-conductive end 22 is shaped so that it grows larger, either steadily or in steps, towards the non-conductive end. Thus, a variety of modes of implementation are possible. Those shown in FIGS. 2(*a*)–2(*d*) are not limiting, and changes can be made as appropriate.

In the implementations above, there is a gap 24 between the functionally gradient material 21 and the lead bar 11 from the point of attachment 26 to the non-conductive end (the left side in the drawings) so that there is no contact between the two. In comparison to the conductive side (the right side in the drawings), the wall thickness of the functionally gradient material 21 is less on the non-conductive side. In these versions, the non-conductive end of the seal 20 has a reduced thermal capacity, and so it is easily welded to the light-emitting tube and the lamp can be reliable sealed.

Next, FIGS. 3(*a*) through 3(*e*) show other modes of implementation of the seal 20 of the invention of this application.

In FIGS. 3(*b*), 3(*c*) and 3(*d*), the outer diameter of the functionally gradient material, at and near the non-conductive end, is less than that of the functionally gradient material at the point of attachment to the lead bar. Because the outer diameter is smaller, the wall thickness of that part is less. However, this invention is not limited to the shapes shown in FIGS. 3(*a*)–3(*e*), and changes can be made as appropriate. The edge of the gap 24 could be flat, or tapered, or rounded as well.

FIG. 3 is a vertical cross section of the non-conductive end of the seal 20. When the wall thickness of the non-conductive end of the functionally gradient material 21 is reduced, as shown in the drawing, the process of sealing the light-emitting tube 10 can be carried out easily and completely, for the same reasons as stated above.

This type of seal 20 can also seal a light-emitting tube using frit glass, for example. When the edge of the opening of the gap 24 has a stepped shape as in FIGS. 3(*c*) and 3(*d*), the position of the tip of the electrode can be set easily when the stepped portion of the seal 20 is inserted in the cylindrical tube of the light-emitting tube. A specific example of this invention is explained below.

The functionally gradient material was produced using silica glass ($SiO_2$) as the non-conductive component and molybdenum (Mo) as the conductive component. First, silica glass-molybdenum powders mixed in 12 different proportions were placed into a mold that had mold core on the bottom to form the insertion hole and gap. Placement in the mold begins with a first layer of silica glass powder, followed by mixed powders of silica glass and molybdenum in different proportions, working from the least to the greatest proportion of molybdenum. The molybdenum of the 12th and final layer was 55 Vol %. FIG. 4 is a table showing the proportions of silica glass and molybdenum and the thickness of each layer of the functionally gradient material.

The layers of mixed powders were then formed into a powder molding by the application of 18×10⁻Pa(120 kgf/cm$^2$).

At this point, the end of the powder molding with the higher proportion of silica glass powder has a lead bar insertion hole with a larger inside diameter, with a gap so that the lead rod and the inside surface of the hole in the powder molding do not touch. The method to accomplish this could be, for example, to mold the hole during pressing, or to cut out a larger hole after the powder molding has been removed from the press. The depth of the gap can be changed during production of the powder molding to obtain powder moldings with different proportions of molybdenum at the point of attachment of the lead bar and the functionally gradient material.

In this implementation, a lead bar made of tungsten wire with a diameter of 1 mm was inserted into the insertion hole, after which the powder molding underwent partial sintering at 1200° C. for about 30 minutes under a hydrogen atmosphere. Following that, the samples were given an oxidation-resistant coating by coating them with an organic solvent containing silica glass, placing them in a sintering oven, and fully sintering them at 1720 to 1750° C. for 10 to 15 minutes.

In addition to the powder moldings described above, conventional seals with no gap between the functionally gradient material and the lead bar were made as control samples. Except for the absence of the gap, these control samples were made in exactly the same way as the test samples, using the same materials and shapes.

Figure 5:
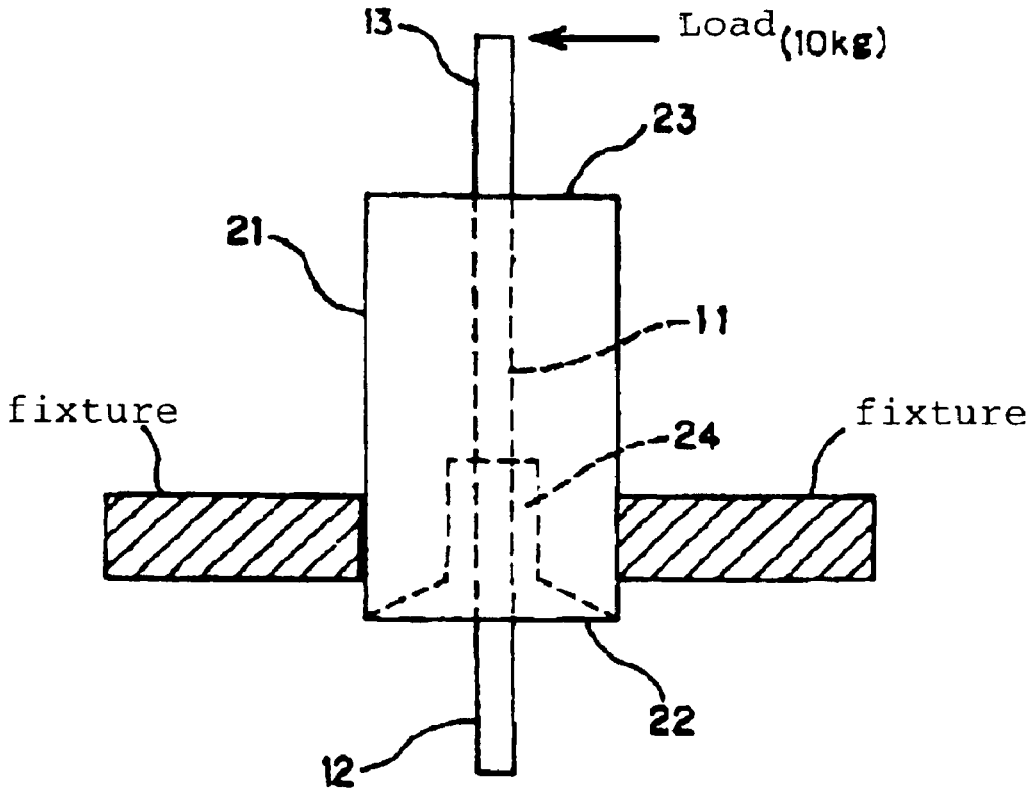
FIG. 5 is an explanatory drawing of a bending test for the seal material in a test case.

Next, the samples thus obtained were examined for mechanical strength at the point of attachment of the functionally gradient material and the lead bar. Using the arrangement shown in FIG. 5, a load of 10 kg was applied perpendicular to the axis of the external lead bar 13, and the samples were inspected macroscopically to assure that no cracks or faults had occurred.

Figure 6A:
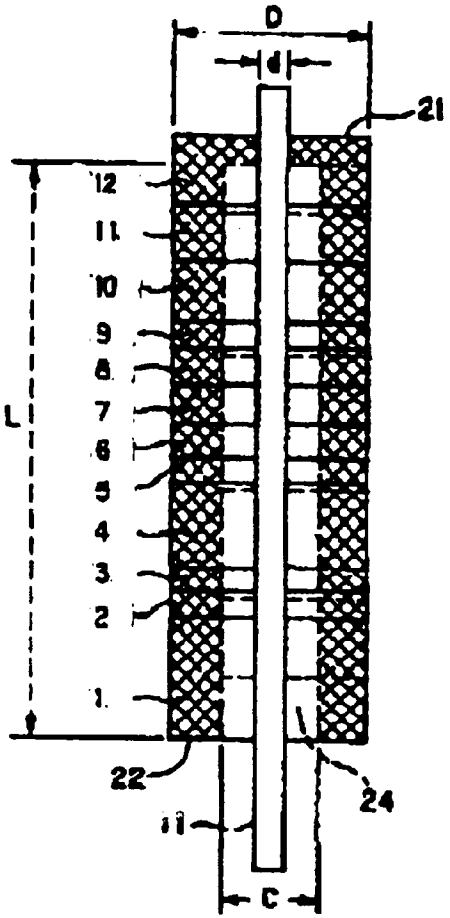
FIGS. 6(*a*) and 6(*b*) are diagrams of a test piece used to explain test case 1, and evaluations of various test pieces in test case 1, respectively.
Figure 6B:
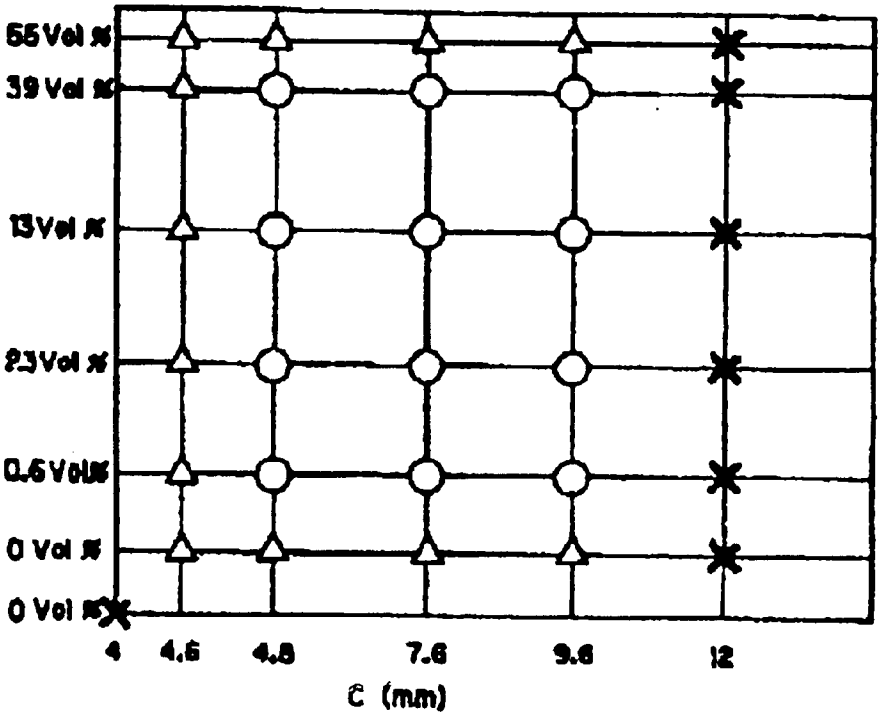

The results of this test are shown in FIGS. 6(*a*) & 6(*b*). FIG. 6(*a*) is a model diagram of the samples used in this test with FIG. 6(*b*) summarizing the results obtained.

In FIG. 6(*b*), the horizontal axis shows the inside diameter C of the insertion hole from the non-conductive end of the functionally gradient material to the point of attachment to the lead bar. The vertical axis shows the depth L from the non-conductive end to the point of attachment, expressed as the proportion (Vol %) of molybdenum in the functionally gradient material. Now, the outside diameter D of the functionally gradient material in these samples was always ϕ16.

The points at which the symbols "○", "Δ", "X" are marked in this figure indicate combinations of inner diameter C and depth L of the holes in the samples. The seals which were samples in this test were produced in five varieties, with inside diameters C for lead bar insertion at 4.6 mm, 4.8 mm, 7.6 mm, 9.6 mm, and 12 mm and in each variety, samples were produced with different gap depths L (mm) to change the proportion of components at the point of attachment.

For example, for the samples with an inside diameter of 4.8 mm for the hole from the non-conductive end to the point of attachment, the figure indicates that six samples were produced with different depths L from the non-conductive end to the point of attachment. The proportion of molybdenum at the point of attachment in these samples was 55 Vol %, 39 Vol %, 13 Vol %, 2.3 Vol %, 0.6 Vol % and 0 Vol %.

Now, the point where L=0 (mm) and C=ϕ4 is the control sample with no gap between the functionally gradient material and the lead bar.

The symbols "○", "Δ", "X" represent evaluations of the various samples as seal end products. Their meanings are given below.

The symbol "○" indicates a sample with no cracking that maintained mechanical strength and did not break in the bending test. It indicates a sample that is well-suited to use as a seal. The symbol "Δ" indicates either a sample with surface cracking during the full sintering, or one that did not maintain mechanical strength, but broke in the bending test. It indicates a sample that survived through the final processing, but could not be used as a seal. The symbol "." indicates a sample that was broken either by handling during production of the functionally gradient material, or during the full sintering, and did not survive through the final processing.

The control samples' functionally gradient material split during the full sintering stage, and could not be given their final shape, and so an "X" is shown for the L=0 (mm), C=ϕ4 sample. From that result, it can be understood that when L=0 (or C=d), production of the functionally gradient material is not possible.

Now, the samples that were evaluated as "○" in the test implementation were actually welded into lamps as seals to check whether there would be any deformation of the seal material during the sealing process. The light-emitting tubes of the lamps were made of silica glass with an outside diameter of 22.7 mm and a tube wall thickness of 2.35 mm.

The result was that all of the samples were able to seal the light-emitting tubes completely without changing shape. It was understood, therefore, that the samples that were evaluated as "○" were well-suited for use as seals.

According to the results of this test, when the proportion of the conductive component at the point of attachment of the lead bar at the silica glass end of the functionally gradient material was lower than 0.6 Vol %, cracking would occur in the functionally gradient material during the cooling stage after the full sintering. And when attempts were made to attach the lead bar to the functionally gradient material at a point where the proportion of the conductive component was greater than 39 Vol %, the strength of the point of attachment of the lead bar and the functionally gradient material was too low, and breakage occurred during the bending test.

Accordingly, by setting the point of attachment of the functionally gradient material and the lead bar such that the proportion of the conductive component of the functionally gradient material is no less than 0.6 Vol % and no greater than 39 Vol %, it is possible to have a lamp seal well-suited to practical use that is easy to manufacture, has good productivity and maintains its mechanical strength.

In this test, the inner diameter of the hole from the non-conductive end to the point of attachment of the functionally gradient material and lead bar was larger than the outer diameter of the lead bar.

Regarding the sample in which the inner diameter C of the hole was a 4.6 mm and the outer diameter of the lead bar d was 4 mm the gap between the functionally gradient material and the lead bar was too small; the two made contact during the full sintering and cracking occurred. In the case of samples in which the inner diameter C of the hole was 4.81 mm or greater, no cracking was seen. Nevertheless, in the sample with an inner diameter C that was too large, specifically a hole diameter of 12 mm compared with an outer diameter D of 16 mm the wall of the functionally gradient material from the point of attachment to the lead bar was too thin, and the powder molding was broken in handling Samples with a smaller hole diameter C, such as that with an inner diameter of 9.6 mm did not break easily in handling and could be used as seals. These seals did not deform during sealing of the light-emitting tubes, and were well-suited to their purpose.

Accordingly, it was learned that when the inner diameter C of the hole was in the range from at least 1.2 times the wire diameter d of the lead bar to no more than 0.6 times the outside diameter D of the functionally gradient material, the finished product had good productivity and was well-suited to use as a lamp seal.

Next, lamp seals covered by inventions of this application were produced using different dimensions for the functionally gradient material and lead bar.

Even after changing the outer diameter D of the functionally gradient material, the wire diameter d of the lead bar, the proportion of the conductive component at the point of attachment of the functionally gradient material and the lead bar, the inner diameter C of the hole, and the materials used for the functionally gradient material and the lead bar, functionally gradient material seals were produced using the same manufacturing process as in the above describe test. The productivity of the seals, the presence of cracking, the mechanical strength and so forth were evaluated, and the results are shown together in FIG. 7.

Effect of Invention (1) In accordance with this invention, it is possible to provide lamp seals with good productivity, in which no cracking of the functionally gradient material occurs in the cooling stage following sintering of the lead bar and the functionally gradient material.

(2) In accordance with the invention of this application, it is possible to provide lamp seals with good productivity, in which there is no breakage in handling of the functionally gradient material even in the powder molding stage, and in which there is no cracking due to contact with the lead bar even when exposed to high temperatures during sintering. It is possible, moreover, to produce lamp seals well-suited to use, which are not deformed and which seal completely during welding to the light-emitting tubes of the lamps.

(3) The invention of this application, enables the welding of the seals to the light-emitting tubes during the sealing process to be performed easily if the non-conductive end is formed thinner than the conductive end.

What is claimed is:

1. A lamp seal comprising:

a functionally gradient material; and a lead bar of tungsten;

wherein the functionally gradient material has layers of mixtures of silica glass as an electrically non-conductive material and molybdenum as a conductive material in which a layer at one end is non-conductive and a layer at an opposite end is conductive, with intervening layers in which the proportion of conductive material increases moving from said one end to said opposite end;

wherein the lead bar passes through a hole extending through the functionally gradient material entering in one of said ends and out the other of said ends;

wherein said hole is cylindrical with an expanded diameter at the non-conductive end, such that the diameter of the cylindrical hole in the region from the non-conductive end of the functionally gradient material to the point of attachment of the lead rod, satisfies the condition $C=1.2d \leqq C \leqq 0.6D$, where C is the diameter of the cylindrical hole in the region from the non-conductive end of the functionally gradient material to the point of attachment of the lead rod, d is an outer diameter of the lead bar and D is an outer diameter of the functionally gradient material;

wherein the lead bar is attached in a conductive region of the functionally gradient material and fixed by the functionally gradient material having been sintered thereto; and wherein the proportion of conductive material at a point of attachment of the lead bar to the functionally gradient material is no less than 0.6. Vol % and no more than 39 Vol %; and wherein a cylindrical gap is located between the lead bar and the functionally gradient material, said cylindrical gap being formed within the functionally gradient material by an enlargement of the inside diameter of the insertion hole which extends from a point of attachment of the lead bar to the functionally gradient material to the non-conductive end of the functionally gradient material.

2. A lamp seal as described in claim 1, wherein the hole expands in a tapered form from the point attachment toward the non-conductive end; and the thickness of the functionally gradient material from the point of attachment to the non-conductive end is less than its thickness at the point of attachment.

3. A lamp seal as described in claim 1, in which the outside diameter of the functionally gradient material at and near the non-conductive end is smaller than the outside diameter at the point of attachment.

* * * * *